US007195372B2

(12) United States Patent
Plunk

(10) Patent No.: US 7,195,372 B2
(45) **Date of Patent: *Mar. 27, 2007**

(54) MASTER-SATELLITE RETROFIT ASSEMBLY AND METHOD OF RETROFITTING RECESSED STRIP LIGHTING FIXTURES

(75) Inventor: Carlton B. Plunk, Saltillo, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/057,506

(22) Filed: Feb. 14, 2005

(65) Prior Publication Data

US 2005/0201094 A1 Sep. 15, 2005

Related U.S. Application Data

(63) Continuation of application No. 10/372,428, filed on Feb. 21, 2003, now Pat. No. 6,854,597, which is a continuation-in-part of application No. 09/865,833, filed on May 25, 2001, now Pat. No. 6,752,513.

(60) Provisional application No. 60/209,925, filed on Jun. 7, 2000.

(51) Int. Cl.
*F21V 23/02* (2006.01)

(52) U.S. Cl. ..... 362/221; 362/225; 362/241; 362/260

(58) Field of Classification Search ..... 362/219, 362/221, 225, 241, 247, 260
See application file for complete search history.

(56) References Cited

U.S. PATENT DOCUMENTS

| | | | | |
|---|---|---|---|---|
| 3,086,105 | A | 4/1963 | Nieder-Westermann | |
| 3,265,886 | A | 8/1966 | Wigert | |
| 5,371,661 | A | 12/1994 | Simpson | |
| 5,440,466 | A | 8/1995 | Belisle et al. | |
| 5,658,066 | A | 8/1997 | Hirsch | |
| 5,720,546 | A | 2/1998 | Correll, Jr. et al. | |
| 5,755,507 | A | 5/1998 | Hucks | |
| 6,027,230 | A | 2/2000 | Huber et al. | |
| 6,210,019 | B1 | 4/2001 | Weathers | |
| 6,305,816 | B1 | 10/2001 | Corcorran et al. | |
| 6,454,431 | B1 * | 9/2002 | Grossman et al. | 362/219 |
| 6,854,860 | B2 * | 2/2005 | Plunk | 362/219 |
| 2002/0001191 | A1 | 1/2002 | Grierson et al. | |

* cited by examiner

*Primary Examiner*—Stephen F Husar
(74) *Attorney, Agent, or Firm*—James E. Cole; Middleton Reutlinger

(57) ABSTRACT

Disclose is a master-satellite assembly for retrofitting a first existing recessed strip light fixture and a second existing recessed strip light fixture in a grid ceiling, where the existing fixtures are arranged end to end and are separated by a T-bar support member. The assembly has a master retrofit fixture, a satellite retrofit fixture and a wire cover bracket. The master retrofit fixture is received within the first existing recessed strip fixture and the satellite retrofit fixture is received within the second existing recessed strip fixture with wiring running under the T-bar support. The wire cover bracket extends from the master retrofit fixture, under the T-bar support member, and to the satellite retrofit fixture in order to cover the wiring. Also disclosed is a method of retrofitting utilizing the master-satellite assembly, and a retrofit reflector configuration utilizing hanger tabs extending from the ends of the retrofit reflector.

16 Claims, 9 Drawing Sheets

MASTER-SATELLITE RETROFIT ASSEMBLY AND METHOD OF RETROFITTING RECESSED STRIP LIGHTING FIXTURES

CROSS-REFERENCE TO RELATED APPLICATIONS

This application is a Continuation of and claims priority to and benefit of U.S. patent application Ser. No. 10/372,428, filed on Feb. 21, 2003, now. U.S. Pat. No. 6,854,597, which will issue on Feb. 15, 2005, which is a Continuation-in-Part of and claims priority to and benefit of U.S. application Ser. No. 09/865,833, filed May 25, 2001, now U.S. Pat. No. 6,752,513, issued on Jun. 22, 2004, which claimed priority to and benefit of U.S. Provisional Application No. 60/209,925, filed Jun. 7, 2000.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to recessed strip lighting fixtures. More particularly, this invention relates to a master-satellite retrofit assembly and a method of retrofitting recessed strip lighting fixtures using the assembly.

2. Description of Prior Art a. Retrofit Recessed Strip Fixture

Higher efficiency, brighter fluorescent lamps with better color rendering are the results of recent development in fluorescent lighting technology. Particularly, these developments have resulted in the availability of new technology lamps with the performance described above. These developments have been of particular interest to large users of recessed strip lighting fixtures, such as department, grocery and other retail stores.

Strip lighting fixtures are commonly utilized in continuous rows to provide economical uniform lighting of large indoor spaces, such as retail stores. Recessing the fixtures above the plane of the ceiling provides for a 'cleaner' look and more visual comfort than 'open' strip fixtures. In the past, these fixtures typically utilized T-12 sized old technology lamps in 8 foot lengths. The fixtures themselves typically measured 1 foot by 8 foot and were installed into inverted "T" (NEMA "G") ceiling systems.

Retail stores desire the ability to more efficiently and effectively illuminate their merchandise and their stores by utilizing the newer technology lamps. However, the newer technology lamps cannot be installed into existing strip fixtures as they require different lamp holders and ballasts.

Replacement of existing fixtures would be very costly, requiring the purchase of completely new fixtures, wiring and construction costs of removing the old fixtures and installing the new fixtures, and, most importantly, the inconvenience and cost of closing down sections of the store as the construction proceeds creating "hard hat areas".

b. Master-Satellite Retrofit Assembly and Method of Retrofitting Recessed Strip Lighting Fixtures Thus, various devices and methods have been developed to address cost and convenience issues involved with retrofitting existing fixtures with newer technology lamps, sockets, and ballasts. One such device is partially described herein, and is further described in U.S. patent application Ser. No. 09/865,833, which is incorporated herein by reference. The compact retrofit fixture described is able to utilize the housing of the existing fixture that is already in the ceiling as the housing for the retrofit fixture to reduce purchase, installation and disposal costs associated with the retrofit process. Furthermore, the retrofit fixture described also improves the speed and convenience of the retrofit process.

A key advantage of the retrofit fixture is that it allows installation without disturbing the ceiling or the plenum area above it, thereby eliminating potential asbestos and other issues associated with disturbing the ceiling or plenum. A further advantage is that the retrofit fixture may be pre-wired and pre-lamped at the factory. Thus, all the installer has to do is remove the old technology lamps from the existing fixture, move the power connection from the existing ballast to the retrofit fixture ballast, and insert the retrofit fixture into the housing of the existing fixture.

In a typical retrofit of a facility with rows of recessed strip fixtures, the process would proceed from fixture to fixture and row to row, with each existing fixture being retrofitted with a retrofit fixture having a new technology ballast and new technology lamp holders holding new technology lamps.

Advances in lighting technology have further improved the light output available from fluorescent lamps, as well as reducing the size of the electronics, or ballasts, needed to operate such lamps. Thus, high output lamps are now available that produce roughly twice the light output as standard lamps, enabling fixtures to provide equivalent illumination with only half of the lamps previously needed. This consolidation of lamps makes it is possible for one high output electronic ballast to power the lamps in two retrofit fixtures (and possibly more), saving the additional cost of providing each retrofit fixture with a separate ballast. This is known as a master-satellite or master-slave configuration.

This master-satellite configuration is desirable, but requires wiring to extend between the ballast of the master fixture and the lamp sockets of the satellite fixtures. Since such wiring typically does not exist between the independent existing fixtures described above, it is an additional component that must be added as a part of the retrofit process. The additional wiring must be run either on the ceiling side or the room side of the fixtures, either above or below the T-bar member that separates the fixtures.

Since the existing fixtures act as housings for the retrofit fixtures, running the wiring on the ceiling side of the fixtures would require cutting holes in the ends of the existing fixtures, accessing the plenum area, and running conduit or armored cable between the fixtures. Additionally, the wiring would need to be protected from the sharp edges of the holes with bushings or the like. This procedure is undesirable as it greatly increases the time and effort required to install the master-satellite fixtures, and requires disturbing the ceiling and plenum.

Thus, running the wiring between the fixtures on the room side of the fixtures below the T-bar member is the preferred method, as it continues to allow installation without disturbing the ceiling or the plenum, and also permits the master-satellite fixtures to be pre-wired.

However, safety code requirements dictate that the wiring be enclosed. Since conduit, armored cable, or the like, would generally be unsightly to view from the room side of the fixtures, an aesthetically pleasing and functional cover is needed to allow the wiring to run between the fixtures on the room side of the fixtures below the T-bar member between the fixtures.

BRIEF SUMMARY OF THE INVENTION

Thus, it is an object of the present invention to provide a master-satellite retrofit kit for retrofitting recessed strip light fixtures, and a method for use thereof.

It is a further object of the present invention to provide an aesthetically pleasing and functional cover is to allow wiring to run between master-satellite retrofit fixtures on the room side of the fixtures below the T-bar member between the fixtures.

These and other objects are achieved through a novel master-satellite lighting assembly for retrofitting a first existing recessed strip light fixture and a second existing recessed strip light fixture installed in an inverted T-bar grid ceiling, where the existing fixtures are arranged end to end and are separated by a T-bar support member. The assembly has a master retrofit fixture, a satellite retrofit fixture and a wire cover bracket. The master retrofit fixture is received within the first existing recessed strip fixture and the satellite retrofit fixture is received within the second existing recessed strip fixture with lamp wiring from the master retrofit fixture running under the T-bar support member to the satellite retrofit fixture. The wire cover bracket also extends from the master retrofit fixture, under the T-bar support member, and to the satellite retrofit fixture in order to cover the wiring.

The master retrofit fixture has a master retrofit reflector. The ballast for powering all of the lamps of the master-satellite assembly is attached to the master retrofit reflector, and the lamp power wiring runs from the ballast. The master retrofit reflector further has a master wiring opening for allowing the wiring to exit from the master retrofit fixture.

The satellite retrofit fixture has a satellite retrofit reflector. The satellite retrofit reflector further has lamp sockets and a satellite wiring opening for allowing the wiring to enter the satellite retrofit fixture and connect to the lamp sockets.

The wire cover bracket has at least one wall which extends from the master wiring opening, under the T-bar support member, and to the satellite wiring opening, whereby the lamp power wiring running between the retrofit fixtures is covered or enclosed.

Additionally, the objects are met by a method of retrofitting recessed strip lighting fixtures utilizing the master-satellite retrofit assembly. The method comprises the steps of installing the master retrofit fixture within the first existing fixture, installing the satellite retrofit fixture within the second existing fixture, and attaching the wire cover bracket between the master retrofit fixture and the satellite retrofit fixture.

DETAILED DESCRIPTION OF THE INVENTION

1. Recessed Strip Retrofit Fixture

Figure 1:
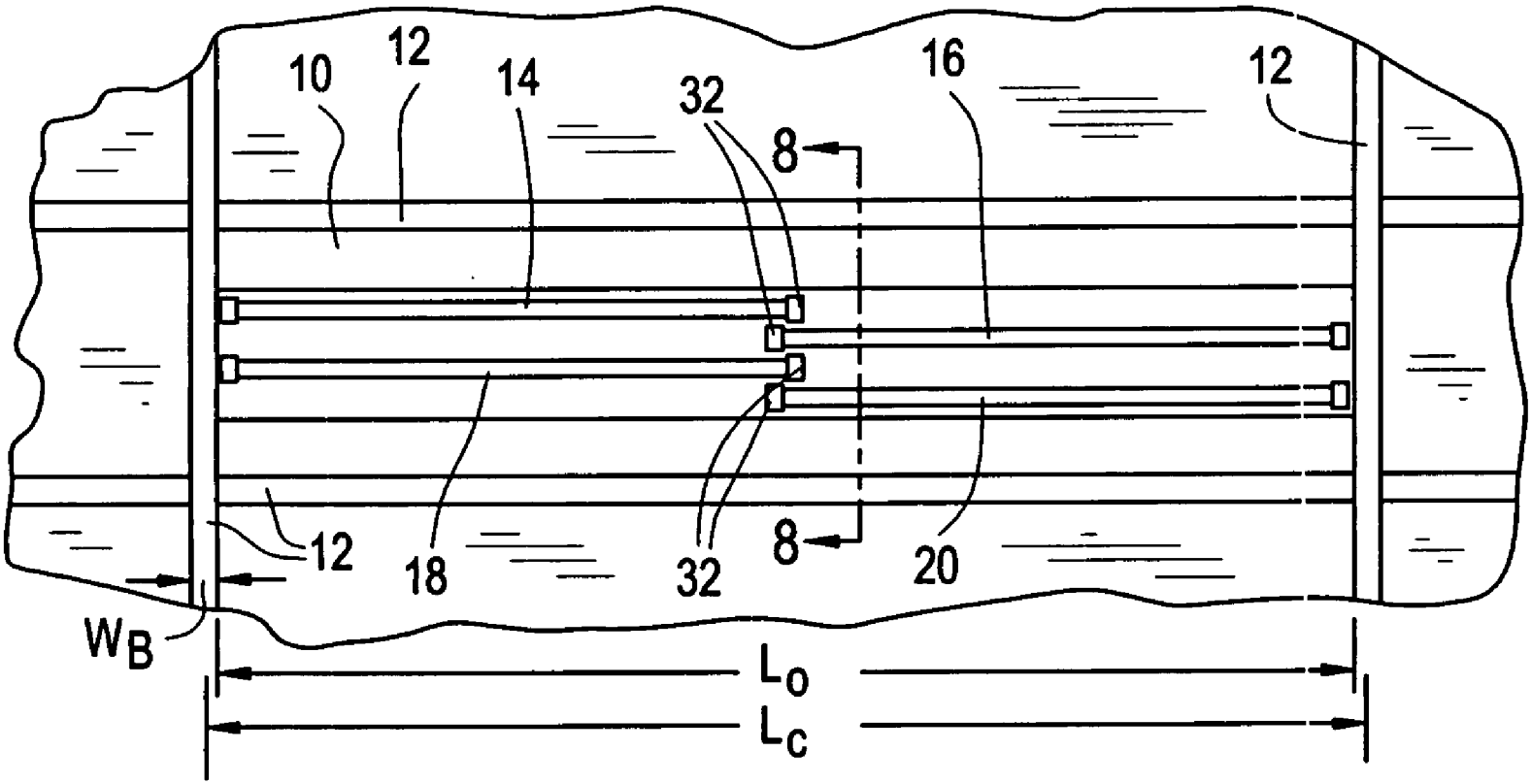
FIG. 1 shows a bottom view of a recessed strip retrofit fixture installed in a ceiling and old recessed fixture.

As shown in FIG. 1, a new technology recessed strip retrofit fixture has a low profile reflector 10 which, when installed, is recessed above the plane of the ceiling. The ceiling plane is defined by an inverted "T" (NEMA "G") ceiling system having "T" bars 12 in a grid pattern.

Also shown in FIG. 1, the retrofit fixture has 2 pairs of new technology lamps 14, 16 and 18, 20 with each lamp being one-half the length of the old technology lamps of the existing fixture. In a typical 1 foot by 8 foot unit, the "T" bars 12 at the end of the fixture will be spaced 96 inches on-center $L_C$, with the width of the "T" bar $W_B$ being 1 inch wide. Thus, the length of the opening between the end "T" bars $L_O$ is 95 inches. Further, any retrofit fixture installable from below the plane of the ceiling into the existing recessed fixture must have a length less than the length of the opening $L_O$.

The length of an 8 foot new technology lamp assembly, including the lamp holders, is approximately 96 inches. Since the lamps of strip fixtures by design are parallel to the sides of the fixture, it is not possible to utilize a 96 inch pre-wired and pre-lamped lamp and socket assembly in the 95 inch opening $L_O$ available for installation of a retrofit fixture from below the plane of the ceiling.

The retrofit fixture shown in FIG. 1, overcomes this limitation through the use of pairs of 48 inch new technology lamps 14, 16 and 18, 20, held by lamp holders 32 and staggered such that the tube assembly ends overlap slightly at the center of the fixture. Thus, the retrofit fixture of the preferred embodiment will fit lengthwise in the 95 inch opening $L_O$.

The principles applied with respect to the 1 foot by 8 foot unit apply equally to other common configurations, including 1 foot by 4 foot, and 1 foot by 16 foot configurations.

Installation of the retrofit fixture into the existing fixture is illustrated in FIG. 2 through FIG. 5. The steps are as follows.

Figure 2:
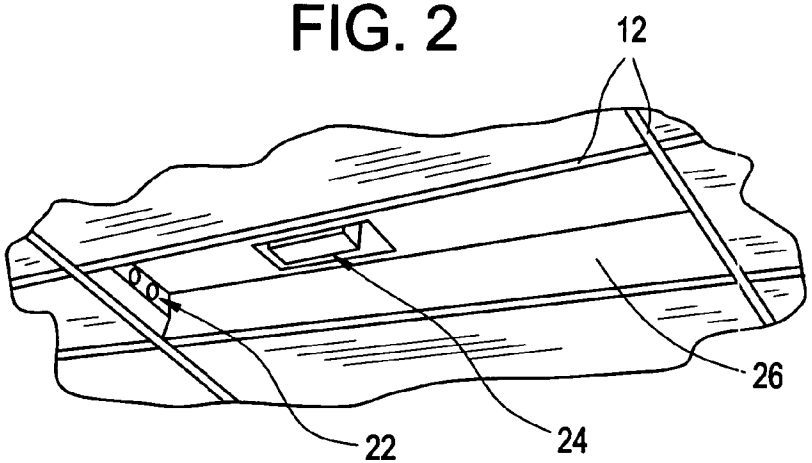
FIG. 2 shows a perspective view of an existing (old technology) recessed fluorescent strip fixture with the old technology lamps and ballast cover removed.

First, power must be disconnected to the existing fixture. Then the existing lamps, and the ballast cover of the existing fixture removed, leaving the existing lamp holders 22 and the existing ballast 24 exposed within the existing fixture housing 26, as shown in FIG. 2.

Figure 3:
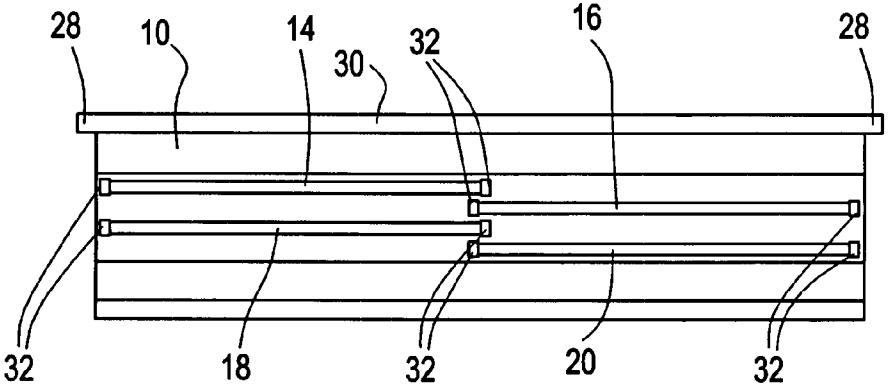
FIG. 3 shows a bottom view of a recessed strip retrofit fixture.

As shown in FIG. 3, the retrofit fixture has hanger tabs 28 extending from a first flange 30 located along a side edge of the retrofit fixture. Also shown in FIG. 3, the retrofit fixture of the present invention may be shipped and installed with the new technology lamps 14, 16, 18, and 20 already installed in the new technology lamp holders 32.

Figure 4:
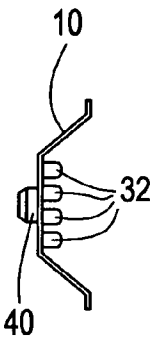
FIG. 4 shows an end view of the fixture of FIG. 3.

A new technology ballast 40 is attached to the top side of the reflector 10, as shown in FIG. 4.

Figure 5:
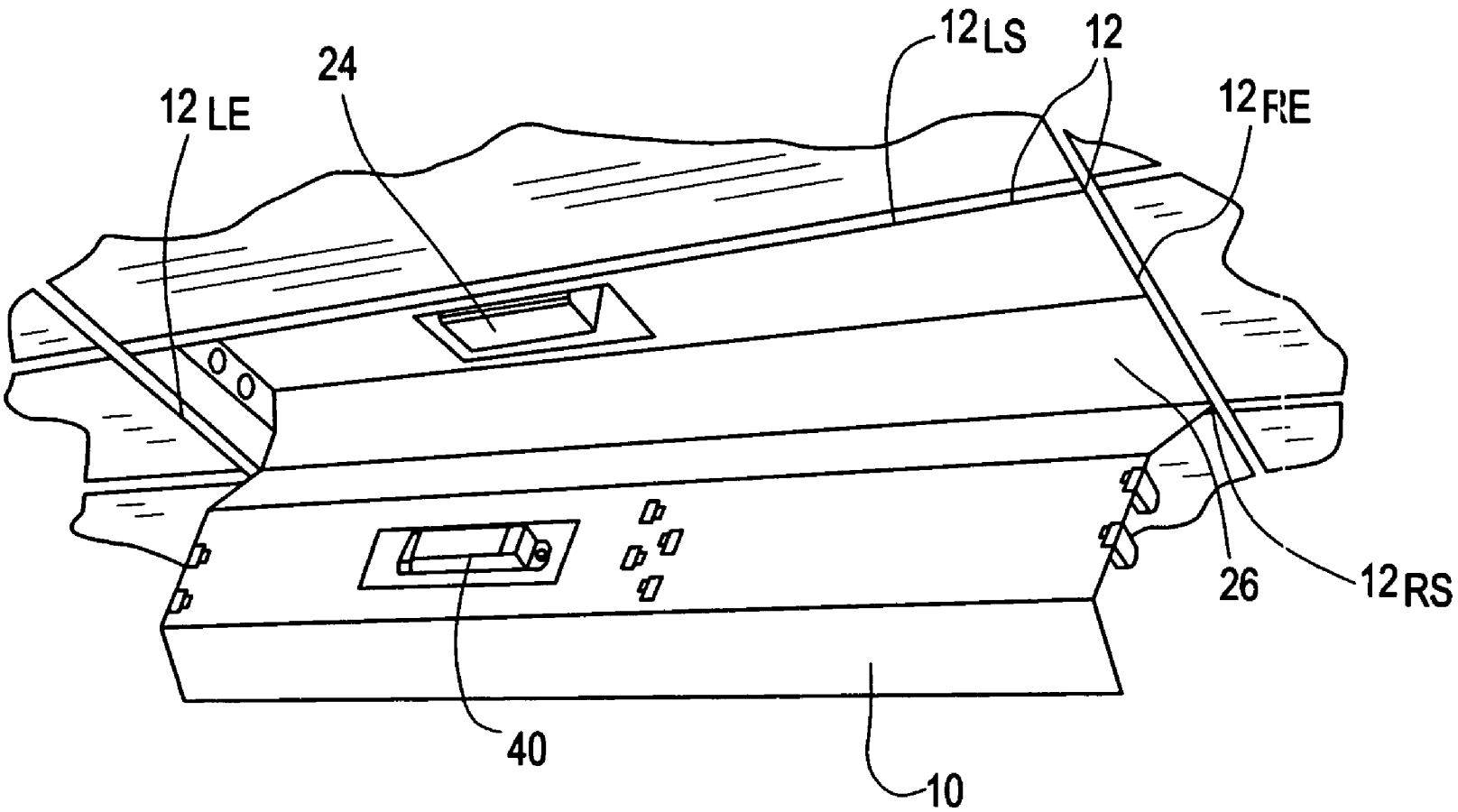
FIG. 5 shows a perspective view of a recessed strip retrofit fixture of the present invention hanging from a "T" bar ceiling grid under an old technology recessed strip fixture.

The next installation step is to hang the retrofit fixture from the "T" bar grid 12 by its hanger tabs 28. This can be accomplished by inserting the retrofit fixture side edge having the hanger tabs 28 to the existing fixture housing 26 diagonally across the opening in the "T" bar grid until the hanger tabs 28 are above the plane of the ceiling. Then the retrofit fixture can be straightened and pushed to the side, as shown in FIG. 5, so that the retrofit fixture will hang from the hanger tabs 28 and be supported by the end "T" bars $\mathbf{12}_{LE}$ and $\mathbf{12}_{RE}$.

The hanger tabs 28 can be formed as a short extension of the 22 gauge material utilized for the reflector 10 and the first flange 30, extending approximately ½ inch long and ¼ in wide. When the fixture is hanging, as shown in FIG. 5, the hanger tabs 28 will be in shear, adequately supporting the weight of the retrofit fixture while the one-man installer makes the following wiring connections.

Figure 6:
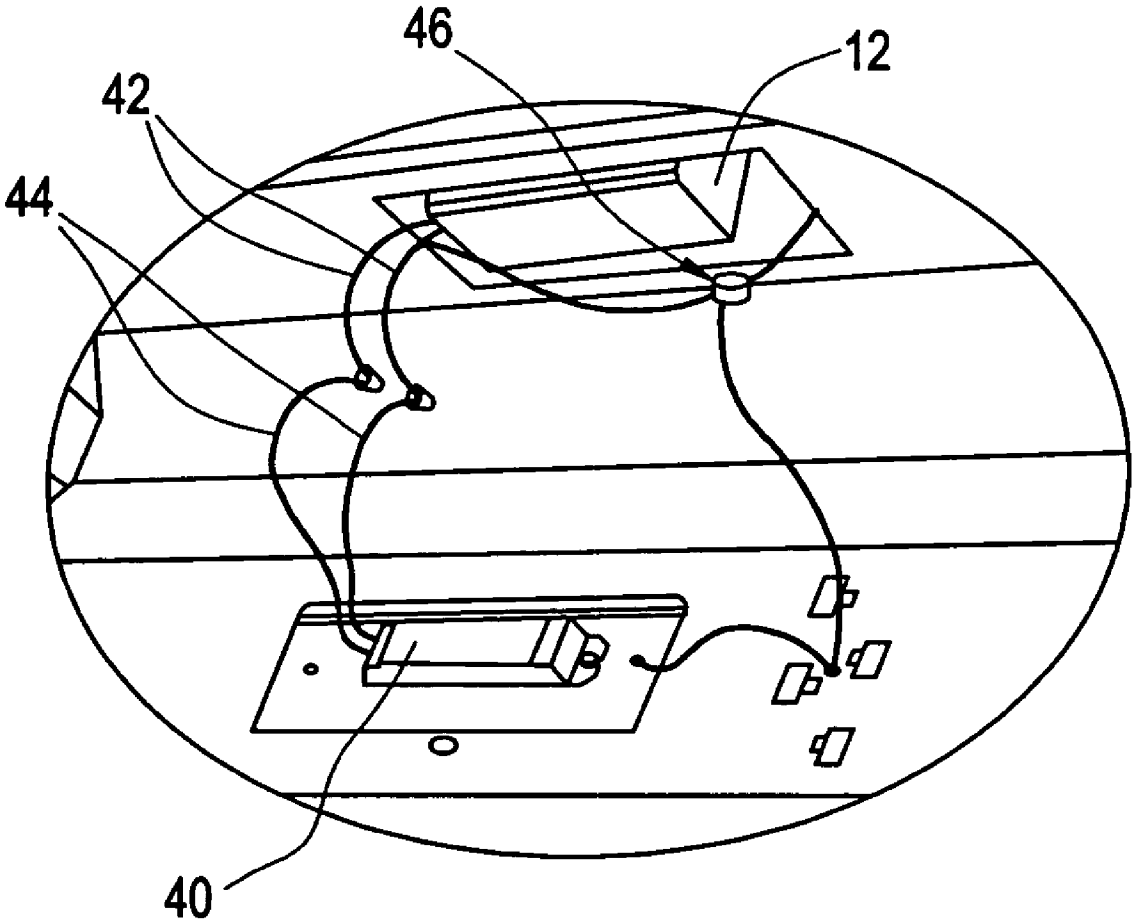
FIG. 6 shows a detail perspective view of the wiring of a recessed strip retrofit fixture to the wiring of an old technology recessed strip fixture.

As shown in FIG. 6, existing power supply leads 42 can be cut from the existing ballast 24 and attached to the new power supply leads 44 for the new technology ballast 40. The fixture and ballast grounds 46 from the existing and retrofit fixtures and ballasts can also be cut and attached.

Figure 7:
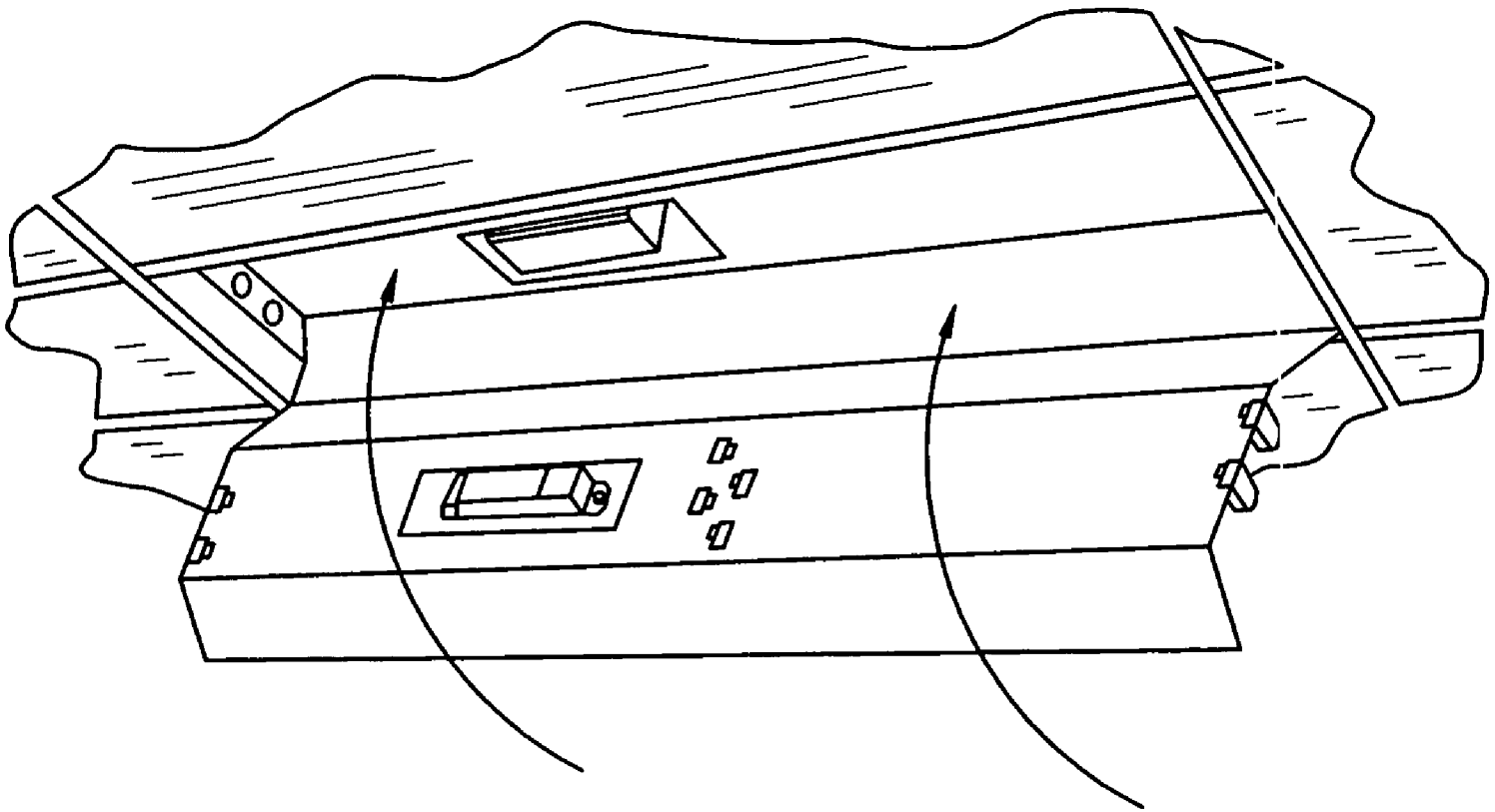
FIG. 7 is an illustration of the step of swinging a recessed strip retrofit fixture of the present invention into position.
Figure 8:
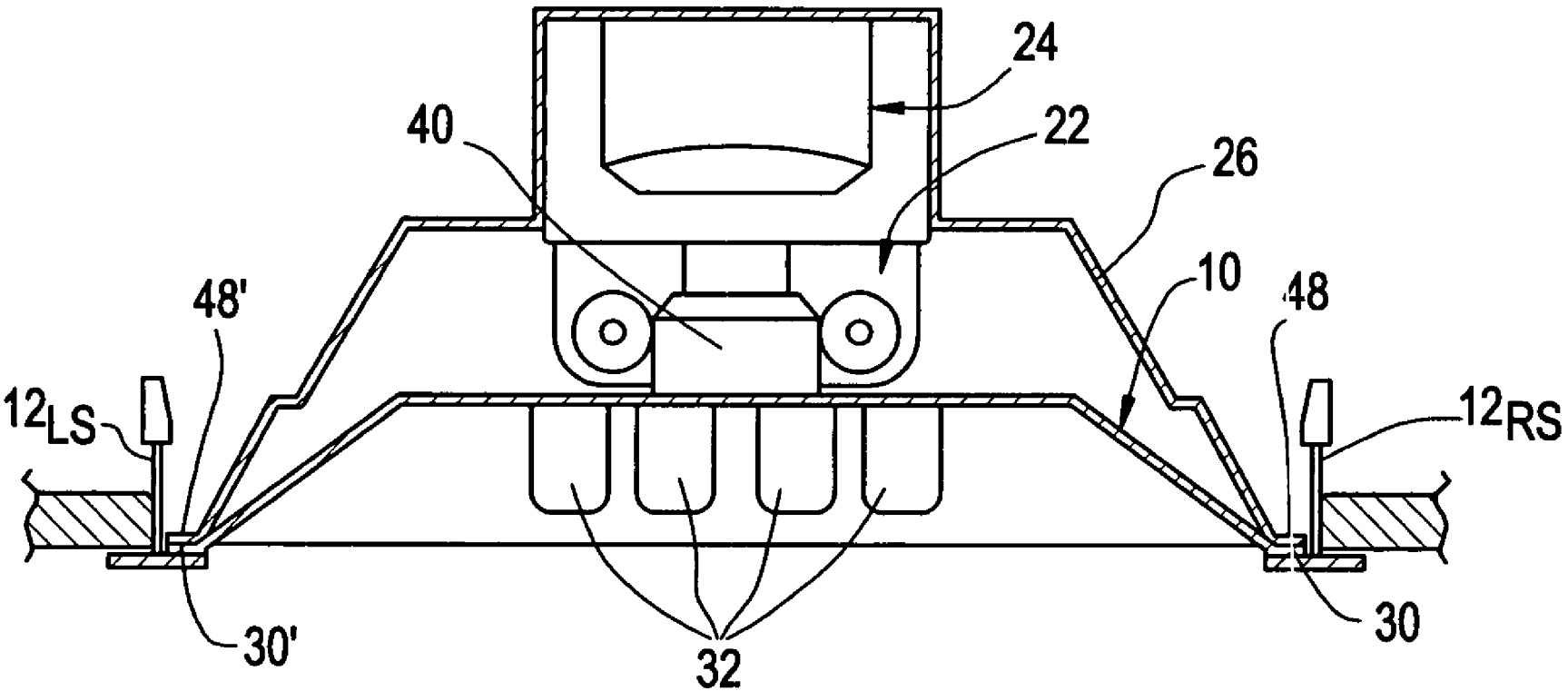
FIG. 8 shows a sectional view of the fixture taken along the line 8—8 of FIG. 1.

As shown in FIGS. 7 and 8, after the wiring connections are complete, the installer may then swing the retrofit fixture up into place transferring the weight of the fixture from the hanger tabs 28 to the first flange 30 supported by the side "T" bar $\mathbf{12}_{RS}$ as it is slid under a first flange 48 of the existing fixture. The retrofit fixture reflector 10 may then be flexed just enough to slide its other flange 30' along the other side edge of the retrofit fixture between other flange 48' of the existing fixture and the other side "T" bar $\mathbf{12}_{LS}$.

As shown in FIG. 8 the depth of the existing fixture housing 26 allows the low profile reflector 10 of the retrofit fixture, along with new technology ballast 40, new technology lamp holders 32 and new technology lamps 14, 16, 18, and 20 to be installed into the existing fixture, utilizing the existing fixture as its housing. This installation can be accomplished by one person from below the plane of the ceiling within a 5 8 minute time frame per unit. Because the existing fixture does not have to be removed, the retrofit can be accomplished with minimal disruption and expense.

In an embodiment, the existing fixture utilizes "old technology" T-12 type fluorescent lamps and lamp holders, and a magnetic ballast, and the retrofit fixture utilizes "new technology" T-8 type fluorescent lamps and lamp holders, and an electronic ballast. However, one of skill in the art will recognize that the principals taught herein will be applicable to many recessed strip retrofit configurations.

2. Master-Satellite Retrofit Assembly and Method of Retrofitting Recessed Strip Lighting Fixtures A master-satellite configuration utilizing modified versions of the recessed strip retrofit fixture along with a new wire cover bracket is shown in FIGS. 9 through 14.

Figure 9:
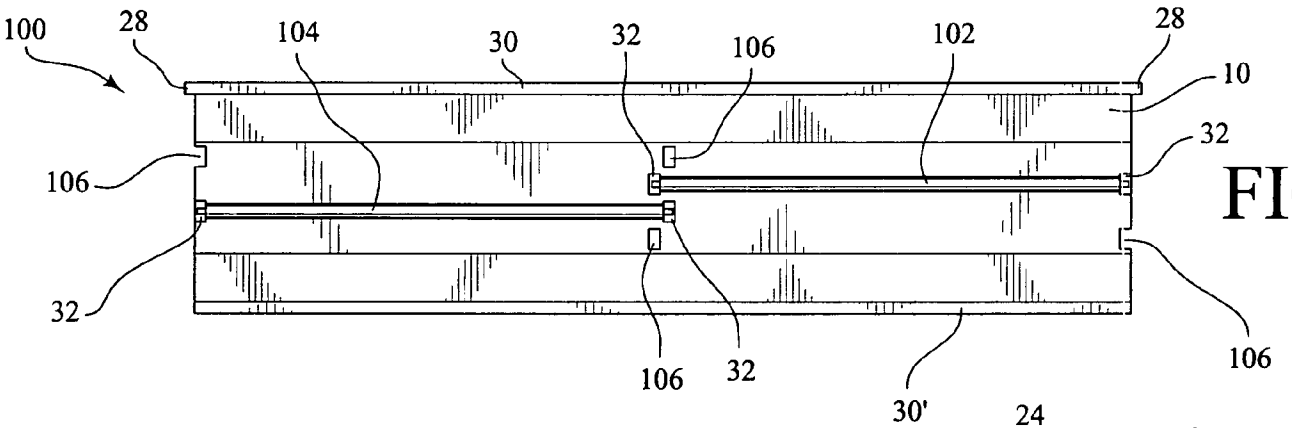
FIG. 9 shows a bottom view of a master-slave type recessed strip retrofit fixture of the present invention.

FIG. 9 shows a bottom view of a modified recessed strip retrofit lamp and reflector assembly 100. For manufacturing convenience, the modified recessed strip retrofit lamp and reflector assembly 100 can utilize the same low profile, elongated, concave shaped reflector 10 as previously discussed. The modification consists of removing two of the new technology lamps (14, 20 of FIG. 3) and their corresponding lamp holders (32 of FIG. 3) leaving the new technology lamp holders 32 for a pair of high output new technology lamps 102, 104. As previously discussed, the high output new technology lamps 102, 104 can produce approximately twice the light output as the regular output new technology lamps of the same length. Thus, only one half of the lamps are required to produce an equal light output. Additionally, lamp holder openings 106 remain where the lamp holders for the removed lamps (14, 20) were located.

Figure 10:
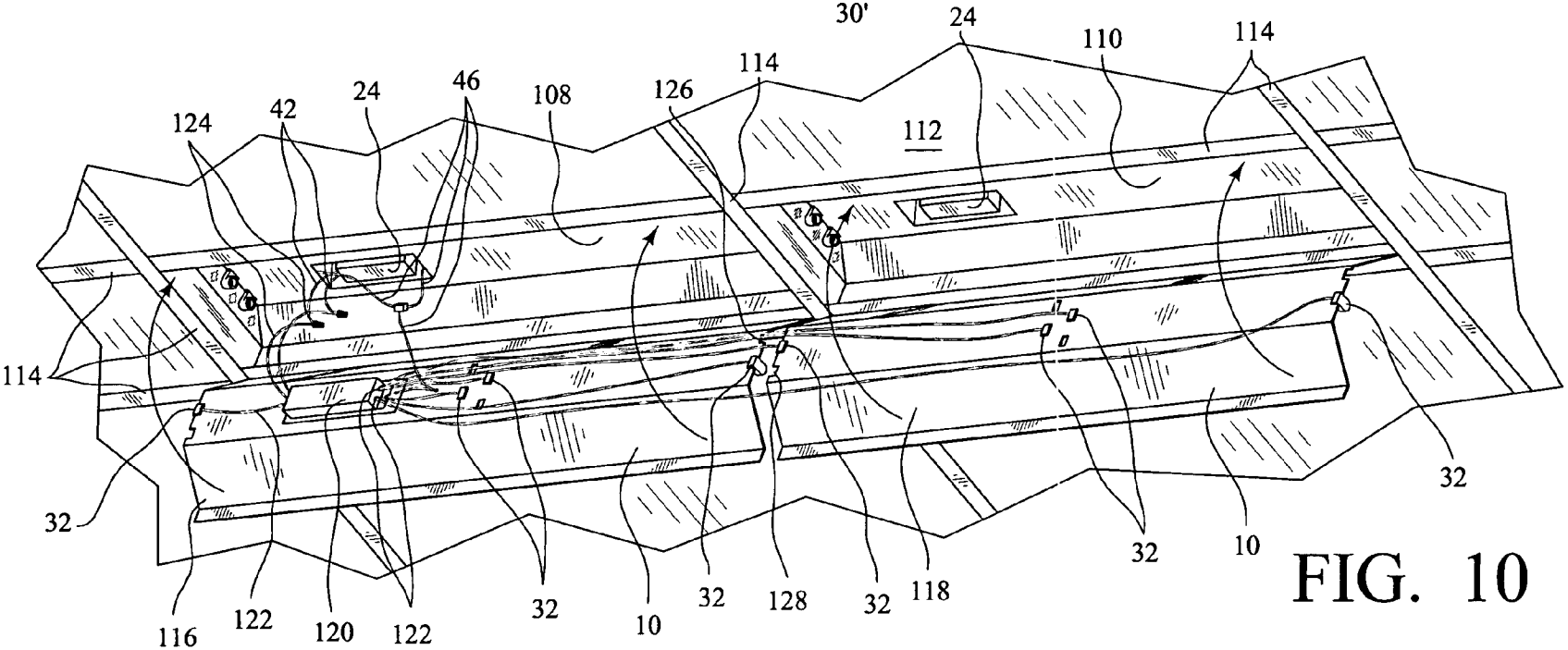
FIG. 10 shows a perspective view of a master recessed strip retrofit fixture and a slave recessed strip retrofit fixture hanging from a T-bar grid ceiling under old technology recessed strip fixtures.

FIG. 10 shows use of the modified recessed strip retrofit lamp and reflector assembly 100 in a master-satellite arrangement.

More specifically, shown are a first existing recessed strip fixture 108 and a second existing recessed strip fixture 110, shown with the respective old technology lamps and existing ballast covers already removed. The existing fixtures 108, 110 are installed in an inverted T-bar grid ceiling 112 which utilizes T-bar support members 114. Also, the existing fixtures 108, 110 are arranged end to end. As discussed earlier, multiples of such fixtures are often arranged end to end in long rows or strips in the ceilings or large retail stores (not shown). The T-bar support members 114 suspend and support the existing fixtures 108, 110. Thus, a T-bar support member separates and supports the existing fixtures 108, 110.

Also shown are a master retrofit fixture 116 and a satellite retrofit fixture 118. Both retrofit fixtures 116, 118 have the modified lamp and reflector assembly 100 described earlier (FIG. 9). However, the master retrofit fixture 116 also has a high output electronic ballast 120 for powering the high output lamps 102, 104 in each retrofit fixture 116, 118. Lamp power wiring 122 runs between the ballast 120 and each lamp socket 32, and, thus, between the master retrofit fixture 116 and the satellite retrofit fixture 118. The high output electronic ballast 120 also has power leads 124.

Further, it should be noted that the lamp power wiring 122 will run between the retrofit fixtures 116, 118 on the room side of the assembly, requiring the wiring 122 to pass under the T-bar support member 114 located between the existing fixtures 108, 110. Since the lamp power wiring 122 runs substantially on the top side of the reflector 10 of each retrofit fixture 116, 118, and each reflector 10 will be received within its corresponding existing fixture 108, 110, it is necessary for each reflector 10 to have a wiring opening to allow the lamp power wiring 112 to the satellite fixture 118 to pass between the fixtures and under the T-bar support member 114 located therebetween. Thus, the reflector 10 of the master retrofit fixture 116 has a master wiring opening 126 positioned adjacent to the end of the reflector 10 which is adjacent to the satellite retrofit fixture 118. Further, the reflector 10 of the satellite retrofit fixture 118 has a satellite wiring opening 128 positioned adjacent to the end of the reflector 10 which is adjacent to the master retrofit fixture 116. In the embodiment shown, the lamp holder openings 106 at adjacent ends of each retrofit fixture 116, 118 can be used for the wiring openings 126, 128, respectively. In actual use, the remaining lamp holder openings 106 would most likely be covered or otherwise closed off to meet code requirements.

Of particular convenience, each retrofit fixture 116, 118 may have the hanger tab configuration described earlier such that the installer can hang them from the T-bar members 114 of the grid ceiling 112 as an installation step, as shown in FIG. 10.

The first existing fixture 108, as well as the second existing fixture 110, have existing power supply leads 42 connected to their existing ballasts 24.

The existing power supply leads 42 of the first existing fixture 108 can then be disconnected from the existing ballast 24 of the first existing fixture 108 and connected to the high output electronic ballast power leads 124. Additionally, the fixture/ballast ground leads of both fixtures 46 should then be connected. The hanging arrangement facilitates these tasks.

Nothing need be done with the existing ballast 24 of the second existing fixture 110 as both retrofit fixtures 116, 118 will be powered by the high output electronic ballast 120 of the master retrofit fixture 116.

Also, of particular convenience, the described configuration allows the retrofit fixtures 116, 118 to be pre-wired and pre-lamped at the factory, so that all the installer must do is hang the retrofit fixtures 116, 118 and connect the ballast power leads 124 to the existing power supply leads 42 of the first existing fixture 108.

Prior to installing the retrofit fixtures 116, 118 into the existing fixtures 108, 110, the lamp power wiring 122 between the retrofit fixtures 116, 118 should be positioned to run through the master wiring opening 126 and the satellite wiring opening 128, respectively.

Assuming the recessed strip retrofit fixture configuration described earlier, the hanging retrofit fixtures 116, 118 can then be swung into place within the existing fixtures 108, 110. However, it should be noted that the principles of the master-satellite retrofit assembly taught herein will apply to whatever manner of installing the retrofit fixtures 116, 118 is applied.

Figure 11:
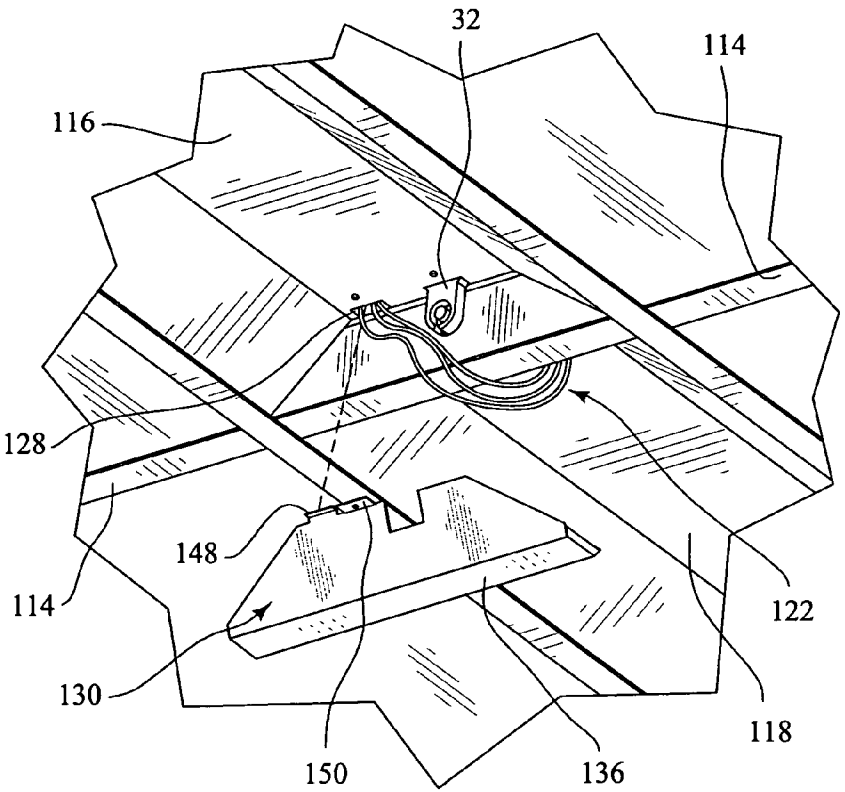
FIG. 11 shows a partial perspective view of master and satellite recessed strip retrofit fixtures installed into old technology recessed strip fixtures with a wire cover bracket exploded therefrom.

Once the retrofit fixtures 116, 118 are installed into the existing fixtures 108, 110, the lamp power wiring 122 will run between the retrofit fixtures 116, 118 through the wiring openings 126, 128 and under the T-bar support member 114 separating the fixtures, as shown in FIG. 11. (For clarity of illustration, FIG. 11 is shown without the high output new technology lamp 104 which would be held in the lamp holder 32.)

Also shown in FIG. 11 is a wiring cover bracket 130, for covering the exposed lamp power wiring 122.

Figure 14:
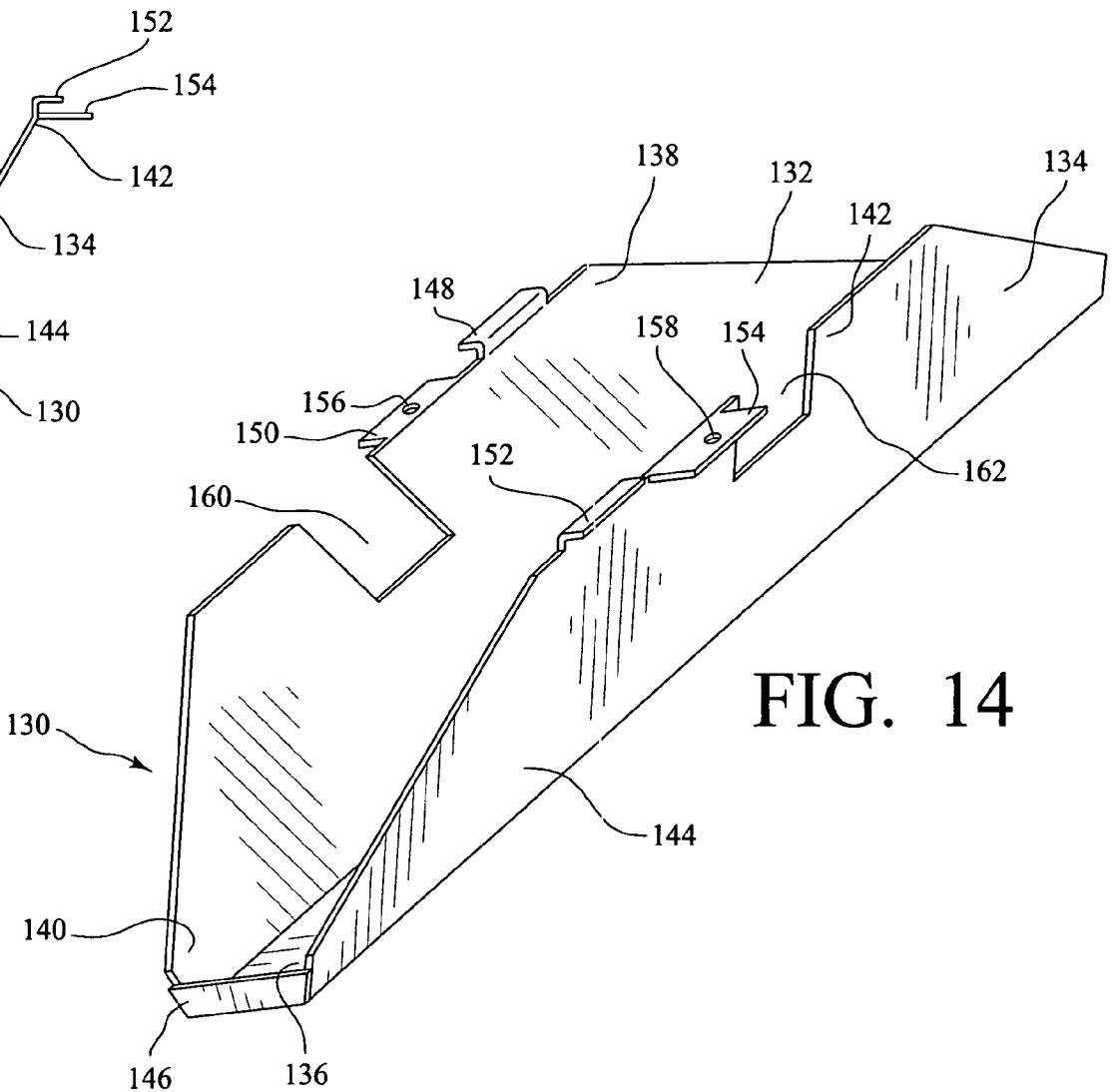
FIG. 14 shows a front view of the wire cover bracket of the present invention.
Figure 13:
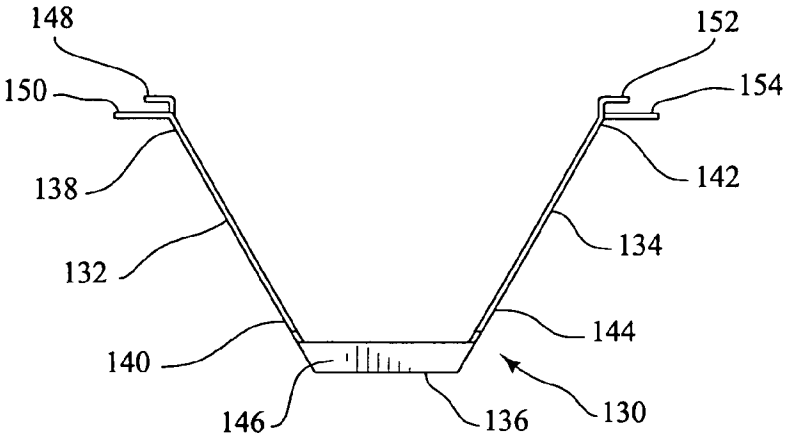
FIG. 13 shows a perspective view of the wire cover bracket of the present invention.

Shown best in FIGS. 13 and 14, the wiring cover bracket 130 of the shown embodiment has a first side wall 132, a second side wall 134 and a bottom wall 136. The first side wall 132 has a top portion 138 and a bottom portion 140. The second side wall 134 also has a top portion 142 and a bottom portion 144. The bottom wall 136 extends between the first side wall bottom portion 140 and the second side wall bottom portion 144.

Figure 12:
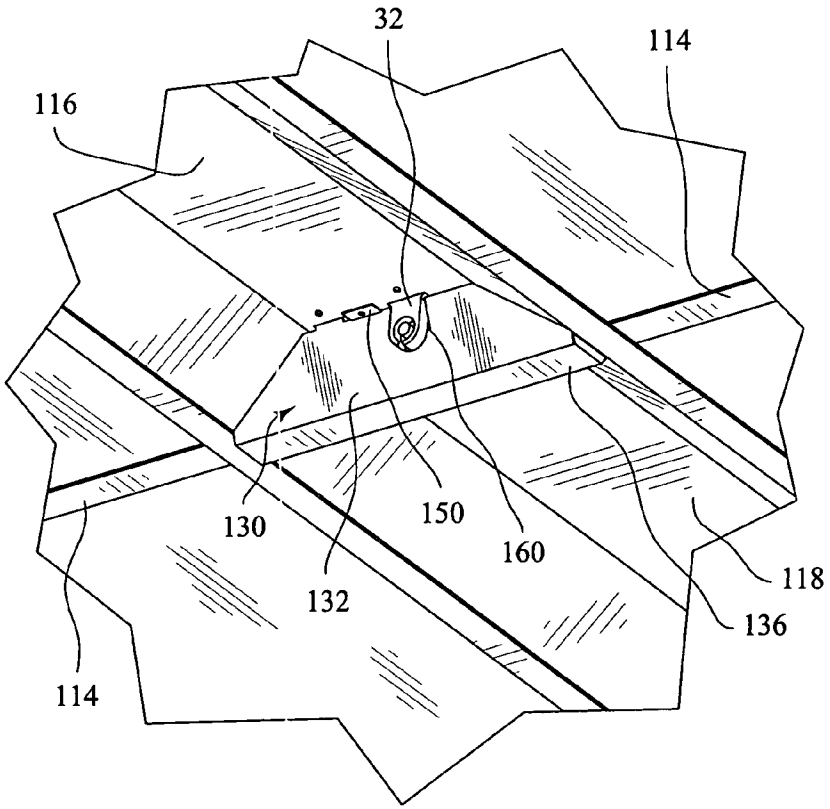
FIG. 12 shows the partial perspective view of FIG. 11 with the wire cover bracket installed between the master and satellite recessed strip retrofit fixtures.

The wire cover bracket 130 is then attached between the retrofit fixtures, as illustrated in FIGS. 11 and 12. Thus, the first side wall 132, second side wall 134 and bottom wall 136 form, all together, a wiring cover that extends from the master wiring opening 126 to the satellite wiring opening 128 and under the T-bar support member 114 between the fixtures.

The side walls 132, 134 are preferably shaped to conform to the shape of the inside of the retrofit fixtures 116, 118. Additionally, end walls 146 may be positioned at either end of the bottom wall 136 to enclose the gap which will exist between the bottom wall 136 and the T-bar support member 114. Thus, the wire cover bracket 130, may form a complete enclosure of the lamp power wiring 122 that runs between the retrofit fixtures 116, 118 and under the T-bar support member 114, as shown in FIG. 12.

Returning to FIGS. 13 and 14, the wire cover bracket 130 of the embodiment shown may also have several tabs positioned along the top portions 138, 142 of the side walls 132, 134. For instance, the first side wall 132 may have an engaging tab 148 and a fastener tab 150. The second side wall 134 may also have an engaging tab 152 and a fastener tab 154.

The engaging tabs 148, 152 are aligned with the lamp holder openings 106 which are used as the wiring openings 126, 128 for the retrofit assembly. The engaging tabs 148, 152 extend upward from the top portions 138, 142 of the respective side walls 132, 134 and bend outward. The wire cover bracket may be fabricated from a unitary piece of code gauge steel, approximately 20/1000 gauge, through a stamping process, which provides a slight flexible resilience of the side walls 132, 134 about the bends which form the bottom wall 136. Thus, the side walls 132, 134 may be squeezed together slightly to allow the engaging tabs 148, 152 to enter the wiring openings 126, 128, and then allowed to spring back out such that the engaging tabs 148, 152 engage the retrofit fixtures 116, 118 and support the wire cover bracket 130. The bend in the engaging tabs 148, 152 additionally serves to protect the lamp power wiring 122 from any sharp edges which may exist along the cut edge of the wiring openings 126, 128.

Fastener tabs 150, 154 may also extend outward from the first side wall 132 and the second side wall 134 to provide a backup means of fastening the wire cover bracket 130 to the retrofit fixtures 116, 118. The fastener tabs 150, 154 may be provided with fastener holes 156, 158 for receiving fasteners, such as screws, rivets or the like, for fastening the wire cover bracket 130 to the retrofit fixtures 115, 118. Such a backup means of fastening would prevent the wire cover bracket from falling from the assembly should the engaging tabs 148, 152 be improperly installed.

Also of note, the wire cover bracket 130 of the embodiment shown has lamp holder openings 160, 162 in its side walls 132, 134 to accommodate the lamp holders 32 of the retrofit fixtures 116, 118, as shown in FIG. 12.

One of skill in the art will recognize that additional wire cover bracket configurations are possible without departing from the teachings of the invention or the scope of the claims which follow.

This detailed description, and particularly the detailed component descriptions of the embodiments disclosed, is given primarily for clearness of understanding and no unnecessary limitations are to be understood therefrom for modifications will become obvious to those skilled in the art upon reading this disclosure and may be made without departing from the spirit or scope of the invention.

What is claimed is:

1. An assembly for retrofitting a first existing recessed strip fixture and a second existing recessed strip fixture comprising:

a master retrofit fixture received within said first existing recessed strip fixture, said master retrofit fixture having:

an master retrofit reflector and lamp sockets attached to said master retrofit reflector; and a ballast attached to said master retrofit reflector;

a satellite retrofit fixture received within said second existing recessed strip fixture, said satellite retrofit fixture having:

a satellite retrofit reflector having a satellite wiring opening; and lamp sockets attached to said satellite retrofit reflector; and, lamp power wiring extending from said ballast of said master retrofit fixture to said satellite retrofit fixture, wherein said ballast powers both said master and satellite fixtures.

2. The assembly of claim 1, said master retrofit fixture further comprising a master wiring opening.

3. The assembly of claim 2, said lamp power wiring extending from said master retrofit wiring opening through a satellite wiring opening and connecting to said satellite fixture lamps.

4. The assembly of claim 2 wherein said master wiring opening is positioned adjacent to the end of said master retrofit reflector that is adjacent to said satellite retrofit fixture, and wherein said satellite wiring opening is positioned adjacent to the end of said satellite retrofit reflector that is adjacent to said master retrofit reflector.

5. The assembly of claim 3 further comprising a wire cover bracket having at least one wall extending from said master wiring opening, under said T-bar support member, and to said satellite wiring opening whereby said wiring is covered.

6. The assembly of claim 5 wherein said wiring cover bracket at least one wall has:

a first side wall having a bottom portion;

a second side wall having a bottom portion; and a bottom wall extending between said first side wall bottom portion and said second side wall bottom portion.

7. The assembly of claim 6 wherein said wiring cover bracket further has a first end wall extending upward from one end of said bottom wall and a second end wall extending upward from the other end of said bottom wall, wherein said wiring cover bracket first side wall is shaped to conform to the shape of the inside of the master retrofit reflector, and wherein said wiring cover bracket second side wall is shaped to conform to the shape of the inside of the satellite retrofit reflector.

8. The assembly of claim 7 wherein said first side wall further has a top portion, wherein said second side wall further has a top portion, wherein said first side wall top portion further has a first engaging tab aligned with said master reflector master wiring opening, wherein said second side wall top portion further has a second engaging tab aligned with said satellite reflector satellite wiring opening, and wherein said wire cover bracket is fabricated from a unitary piece of a resilient material.

9. The assembly of claim 8 wherein said first engaging tab extends upward from said first side wall top portion and bends outward therefrom, and wherein said second engaging tab extends upward from said second side wall top portion and bends outward therefrom.

10. The assembly of claim 7 wherein said wire cover bracket first side wall top portion further has a first fastener tab extending therefrom, and wherein said wire cover bracket second side wall top portion further has a second fastener tab extending therefrom.

11. The assembly of claim 7 wherein said wire cover bracket first side wall further has a first lamp holder opening, and wherein said wire cover bracket second side wall further has a second lamp holder opening.

12. A method of retrofitting a first existing recessed strip fixture and a second existing recessed strip fixture installed in an inverted T-bar grid ceiling, said fixtures arranged end-to-end and separated by a T-bar support member, said method comprising the steps of:

installing a master retrofit fixture within said first existing recessed strip fixture, said master retrofit fixture comprising:

a master retrofit reflector;

a ballast attached to said master retrofit reflector;

lamp power wiring connected to said ballast and extending through said master retrofit fixture;

installing a satellite retrofit fixture within said second existing recessed strip fixture, said satellite retrofit fixture comprising:

a satellite retrofit reflector; and lamp sockets attached to said satellite retrofit reflector and connected to said lamp power wiring for electrical communication with said ballast.

13. An assembly for retrofitting a first existing recessed strip fixture and a second existing recessed strip fixture in end-to-end arrangement, comprising:

a master retrofit fixture comprising:

a master retrofit reflector;

a plurality of master lamp sockets adjacent said reflector, a ballast disposed on said reflector, and lamp power wiring extending between said ballast and said master lamp sockets;

a satellite retrofit fixture, comprising:

a satellite retorfit reflector;

a plurality of satellite lamp sockets, and power wiring extending from said ballast to said satellite lamp sockets;

a wire cover bracket covering said lamp power wiring extending between said master retrofit reflector and said satellite retrofit reflector.

14. A retrofitting assembly for retrofitting existing recessed strip fixtures, comprising:

a first master retrofit fixture comprising a first reflector and a first plurality of lamp sockets adjacent said first reflector;

a ballast attached to said first reflector and in electrical communication with said first lamp sockets;

a second satellite retrofit fixture comprising a second reflector and a second plurality of lamp sockets adjacent said second reflector;

said ballast in electrical communication with said second plurality of lamp sockets providing a master and satellite arrangement.

15. The assembly of claim 14, said first master retrofit fixture and said second satellite retrofit fixture being substantially equivalent in size.

16. The assembly of claim 15, said first master retrofit fixture and said second satellite retrofit fixture arranged adjacent along corresponding sides.

* * * * *